US012202694B2

(12) United States Patent
Bayzelon et al.

(10) Patent No.: US 12,202,694 B2
(45) Date of Patent: Jan. 21, 2025

(54) APPARATUS AND METHOD FOR THE MAKING OF PRESSURE-SENSITIVE LABELS

(71) Applicant: EQUIPEMENTS DE TRANSFORMATION IMAC (E.T.I.) INC., Longueuil (CA)

(72) Inventors: François Bayzelon, Chambly (CA); Maxime Bayzelon, La Prairie (CA)

(73) Assignee: EQUIPEMENTS DE TRANSFORMATION IMAC (E.T.I.) INC., Longueuil (CA)

( * ) Notice: Subject to any disclaimer, the term of this patent is extended or adjusted under 35 U.S.C. 154(b) by 848 days.

(21) Appl. No.: 17/275,881

(22) PCT Filed: Sep. 11, 2019

(86) PCT No.: PCT/CA2019/051283
§ 371 (c)(1),
(2) Date: Mar. 12, 2021

(87) PCT Pub. No.: WO2020/051700
PCT Pub. Date: Mar. 19, 2020

(65) Prior Publication Data

US 2021/0284481 A1 Sep. 16, 2021

Related U.S. Application Data

(60) Provisional application No. 62/730,187, filed on Sep. 12, 2018.

(51) Int. Cl.
*B65H 35/00* (2006.01)
*B65H 20/02* (2006.01)
(Continued)

(52) U.S. Cl.
CPC ..... *B65H 35/0086* (2013.01); *B65H 20/02* (2013.01); *B65H 37/002* (2013.01);
(Continued)

(58) Field of Classification Search
CPC ..... B65H 20/02; B65H 2301/51122; B65H 2404/147; B65H 2701/19404;
(Continued)

(56) References Cited

U.S. PATENT DOCUMENTS

| | | | | |
|---|---|---|---|---|
| 5,405,475 | A | 4/1995 | Kraft et al. | |
| 10,513,102 | B2 * | 12/2019 | Igari | B65H 18/08 |
| 2021/0284481 | A1 * | 9/2021 | Bayzelon | B65H 20/02 |

FOREIGN PATENT DOCUMENTS

| | | | | |
|---|---|---|---|---|
| EP | 1919702 | B1 | 3/2013 | |
| EP | 2976266 | B1 | 12/2016 | |
| GB | 2147236 | A * | 5/1985 | B26D 7/18 |

OTHER PUBLICATIONS

Translation of DE-202007006218-U1.*
(Continued)

*Primary Examiner* — Sonya M Sengupta
(74) *Attorney, Agent, or Firm* — Damien Calvet; Gowling WLG (Canada) LLP

(57) ABSTRACT

Apparatus and method for the making of a pressure-sensitive adhesive stock for labels using a label production line, are disclosed. The stock comprises a first layer of facestock material configured to be die-cut to form the stock of labels surrounded by a matrix, the first layer being backed by a layer of pressure-sensitive adhesive, which in turn is covered by a release liner. 5 The apparatus and method allow the matrix of the facestock to be peeled-off from the release liner on the label production line without stopping the label production line by merely slowing down the label production line. A pressure-sensitive adhesive stock free of the
(Continued)

matrix of the facestock is therefore produced without lowering production yields.

6 Claims, 8 Drawing Sheets

(51) Int. Cl.
*B65H 37/00* (2006.01)
*B65H 41/00* (2006.01)

(52) U.S. Cl.
CPC .... *B65H 41/00* (2013.01); *B65H 2301/51122* (2013.01); *B65H 2404/147* (2013.01); *B65H 2701/19404* (2013.01); *B65H 2801/75* (2013.01)

(58) Field of Classification Search
CPC ..... B65H 2801/75; B65H 35/0086; B65H 37/002; B65H 41/00
See application file for complete search history.

(56) References Cited

OTHER PUBLICATIONS

Translation of EP2687449.*
International Preliminary Report on Patentability dated Mar. 9, 2021 for corresponding PCT application PCT/CA2019/051283.

* cited by examiner

APPARATUS AND METHOD FOR THE MAKING OF PRESSURE-SENSITIVE LABELS

CROSS-REFERENCE TO RELATED APPLICATIONS

The present non-provisional patent application is a U.S. National Phase of International Patent Application PCT/CA2019/051283, filed Sep. 11, 2019, which is hereby incorporated by reference in its entirety and which claims the benefits of priority of the U.S. provisional patent Application No. 62/730,187, entitled "Apparatus and Method For The Making Of Pressure-Sensitive Labels", and filed at the United States Patent and Trademark Office on Sep. 12, 2018, the content of which is also incorporated herein by reference.

TECHNICAL FIELD OF THE INVENTION

The present invention relates to an apparatus and a method for the making of labels and, more particularly, for the making of die-cut pressure-sensitive labels mounted on a release liner and from which the matrix has been removed.

BACKGROUND OF THE INVENTION

A pressure-sensitive adhesive stock for labels generally comprises a layer of face or facestock material for the label or sign backed by a layer of pressure-sensitive adhesive and/or a silicon layer, which in turn is covered by a release liner. The release liner, also named the liner hereinafter, supports the product through manufacturing and life of use, and also protects the adhesive until it is applied to the end use surface. The liner allows for efficient handling of an array of individual labels after the labels are die-cut from the layer of facestock material and up to the point where the individual labels are dispensed in sequence on a labelling line. During the time from die-cutting to dispensing, the liner remains uncut and may be rolled and unrolled for storage, transit and deployment of the array of individual labels carried thereon.

Cutting the facestock to form the labels also produces a remaining portion of the facestock around the labels known as the matrix. The matrix is generally removed from the release liner on the label production line before being rolled for storage and/or shipping to ease the dispense of the labels on the labelling line, to reduce the weight of label rolls and to let the label ready for apply. The removing of the matrix from the release liner generally implies that the label production line be stopped to manually initiate the peel-off of the matrix from the release liner before restarting the production line. Stopping the line implies that the pressure-sensitive adhesive stock be realigned in printing register before restarting the line. These actions lower production yields thereby increase overall costs, including environmental costs.

There is thus a need for new apparatus and method for the making of pressure-sensitive labels which allow removing the matrix from the release liner without having to stop the label production line.

SUMMARY OF THE INVENTION

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

As described herein, it is disclosed an apparatus and a method for the making of a pressure-sensitive adhesive stock for labels using a label production line, the stock comprising a first layer of facestock material configured to be die-cut to form the stock of labels surrounded by a matrix, the first layer being backed by a layer of pressure-sensitive adhesive, which in turn is covered by a release liner, the pressure-sensitive adhesive stock being free of the matrix of the facestock.

As described herein, it is disclosed an apparatus and a method for the making of a pressure-sensitive adhesive stock for labels using a label production line, wherein the matrix of the facestock is peeled-off from the release liner on the label production line without stopping the label production line.

As described herein, it is disclosed an apparatus and a method for the making of a pressure-sensitive adhesive stock for labels using a label production line, wherein the matrix of the facestock is peeled-off from the release liner on the label production line while slowing down the label production line.

According to a first aspect, the invention is directed to an apparatus for the making of a stock strip of pressure-sensitive adhesive stock of labels using a label production line, the stock strip comprising a facestock layer configured to be die-cut to form the stock of labels surrounded by a matrix, the facestock layer being backed by a pressure-sensitive adhesive layer covered by a release liner, the label production line comprising a die-cut station for die-cutting the strip to form the labels and the matrix. The apparatus comprises: a pre-cutting station located upstream the cutting station of the label production line, and configured for receiving the strip and pre-cutting the facestock layer along a width of the facestock layer and transversally a longitudinal direction of the label production line; and a bending station located downstream the pre-cutting station of the label production line, and configured for receiving the strip with the pre-cut facestock and bending the strip along the release liner in order to disengage the pre-cut facestock from the release liner. The pre-cutting and bending stations are synchronized in use with the die-cut station for starting die-cutting the stock strip when the pre-cut facestock is disengaged from the release liner in order to discard the matrix as a continuity of the pre-cut facestock disengaged from the release liner to make the pressure-sensitive adhesive stock free of the matrix.

According to a preferred embodiment, the pre-cutting station comprises a cutting roller positioned adjacent to an anvil roller, the cutting roller comprising a blade extending from a cylindrical surface of the cutting roller for cutting the facestock layer to form the lateral cut when the stock passes through a cutting space defined between the anvil and cutting rollers.

According to a preferred embodiment, the cutting and anvil rollers are configured to be moved apart from a cutting position where the blade cuts the facestock layer to a non-cutting position where the stock moves freely between the anvil and cutting rollers once the facestock has been cut by the blade.

According to a preferred embodiment, the blade extends from the cylindrical surface of the cutting roller with a direction forming a non-perpendicular angle with an edge of the cutting roller in order for the blade to form a lateral cut non-perpendicular to the longitudinal direction of the label production line, the non-perpendicular lateral cut forming as such an oblique portion of the feedstock layer to ease the disengagement of the feedstock layer from the release liner.

According to a preferred embodiment, the bending station comprises: a first supporting roller, and optionally a second supporting roller located above the first roller, for receiving and maintaining the stock strip; a third supporting roller located downstream the first supporting roller for receiving and maintaining the stock strip while providing longitudinal tension to the stock strip in order to maintain the stock strip in a curved position when moving around the first roller; and a movable plate located adjacent to the first roller on the path of the stock strip between the first and third rollers, the movable plate comprising a tip edge for contacting the release liner along the width of the stock strip when the stock strip is moving, the movable plate being configured to be moved between: an inactive position where the tip edge of the plate is not contacting the release liner, and an active position where the tip edge of the plate is contacting the release liner in a way that the stock strip forms a sharp angle when moving around the tip edge of the plate. Preferably, the bending station comprises said second supporting roller located above the first roller, the movable plate in its active position being located adjacent to the second supporting roller. Preferably, the tip edge of the movable plate has a round shape.

According to a second aspect, the invention is directed to a method for the making of a stock strip of pressure-sensitive adhesive stock of labels using a label production line. The stock strip comprises a facestock layer configured to be die-cut to form a stock of labels surrounded by a matrix, the facestock layer being backed by a pressure-sensitive adhesive layer covered by a release liner. The method comprises the steps of: providing the stock strip to the label production line; pre-cutting the facestock layer of the stock strip all along a width of the facestock layer and transversally a longitudinal direction of the label production line; bending the stock strip along the release liner to form a sharp angle in order to disengage the pre-cut facestock from the release liner; die-cutting the pressure-sensitive adhesive stock to form the labels and the matrix; and discarding the matrix as a continuity of the pre-cut facestock disengaged from the release liner, the pressure-sensitive adhesive stock being then free of the matrix. The steps of the method are performed while the production line is running.

According to a preferred embodiment, the method further comprises the steps of: reducing a speed of the label production line before pre-cutting the facestock layer; and rising the speed of the label production line while discarding the matrix. Preferably, the speed is reduced from about 200 m/min to about 15 m/min.

According to a preferred embodiment, the method further comprises the step of applying a longitudinal tension on the stock strip while bending the stock strip.

According to a preferred embodiment, the step of disengaging the pre-cut facestock from the release liner comprises pealing-off the feedstock layer from the release liner when the stock strip is moving.

According to a preferred embodiment, the step of pre-cutting the facestock layer of the stock strip comprises forming a lateral cut non-perpendicular to the longitudinal direction of the label production line in order to form an oblique portion of the feedstock layer to ease the disengagement of the feedstock layer from the release liner. Preferably, the oblique portion is manually or automatically caught before disengaging the pre-cut facestock from the release liner.

According to a third aspect, the invention is directed to a label production line for the making of a stock strip of pressure-sensitive adhesive stock of labels without stopping the label production line. The stock strip comprises a facestock layer configured to be die-cut to form the stock of labels surrounded by a matrix, the facestock layer being backed by a pressure-sensitive adhesive layer covered by a release liner. The label production line comprises: a die-cut station for die-cutting the facestock layer of the stock strip to form the labels and the matrix; a pre-cutting station located upstream the cutting station of the label production line, wherein the bending station comprises a cutting roller positioned adjacent to an anvil roller, the cutting roller comprising a blade extending from the cylindrical surface of the cutting roller for cutting the facestock layer to form a lateral cut when the stock passes through a cutting space defined between the anvil roller and the cutting roller, the lateral cut being formed all along a width of the facestock layer and transversally a longitudinal direction of the label production line; and a bending station located downstream the pre-cutting station of the label production line. The bending station comprises: a first supporting roller, and optionally a second supporting roller located above the first roller, for receiving and maintaining the stock strip; a third supporting roller located downstream the first supporting roller for receiving and maintaining the stock strip while providing longitudinal tension to the stock strip in order to maintain the stock strip in a curved position when moving around the first roller; and a movable plate located at adjacent to the first roller on the path of the stock strip between the first and third rollers, the movable plate comprising a tip edge for contacting the release liner along the width of the stock strip, the movable plate being configured to be moved between: an inactive position where the tip edge of the plate is not contacting the release liner, and an active position where the tip edge of the plate is contacting the release liner in a way that the stock strip forms a sharp angle when moving around the tip edge of the plate in order to disengage the pre-cut facestock from the release liner. The pre-cutting and bending stations are synchronized in use with the die-cut station for starting die-cutting the stock strip when the pre-cut facestock is disengaged from the release liner in order to discard the matrix as a continuity of the pre-cut facestock disengaged from the release liner to make the pressure-sensitive adhesive stock free of the matrix. Also, the label production line is running while the pre-cut facestock is disengaged from the release liner to make the pressure-sensitive adhesive stock free of the matrix.

According to a preferred embodiment, the cutting and anvil rollers of the label production line are configured to be moved apart from a cutting position where the blade cuts the facestock layer to a non-cutting position where the stock moves freely between the anvil and cutting rollers once the facestock has been cut by the blade. Also, the blade extending from the cylindrical surface of the cutting roller preferably forms a non-perpendicular angle with an edge of the cutting roller in order for the blade to form a lateral cut non-perpendicular to the longitudinal direction of the label production line, the non-perpendicular lateral cut forming an oblique portion of the feedstock layer to ease the disengagement of the feedstock layer from the release liner.

According to a preferred embodiment, the bending station of the label production line comprises the second supporting roller located above the first roller, the movable plate in its active position being located adjacent to the second supporting roller. Preferably, the tip edge of the movable plate has a round shape.

According to a preferred embodiment, the label production line is configured to have its speed reduced from about 200 m/min to about 15 m/min before activating the pre-cutting and bending station.

The present invention advantageously allows the production of stock labels free of the matrix while maintaining the strip moving on the production line (without stopping the production line). The speed of the moving strip is merely reduced. In general, the speed of the strip on the production line is about 200 meters per minute (m/min) when the labels are die-cut and is decelerated to about 15 m/min when the matrix needs to be peeled off.

Other and further aspects and advantages of the present invention will be better understood upon the reading of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION

A novel apparatus and related method for the making of pressure-sensitive labels will be described hereinafter. Although the invention is described in terms of specific illustrative embodiments, it is to be understood that the embodiments described herein are by way of example only and that the scope of the invention is not intended to be limited thereby.

Reference is now made to the drawings, in which FIGS. 1 to 4 show a portion of an apparatus 1 for the making of a pressure-sensitive label stock 3. The apparatus of the FIGS. 1-4 comprises a variety of different systems that are not affected by the present invention. Furthermore, it will be understood that the various elements are not drawn to scale, but that the some or all features of the invention may have been modified (e.g., magnified) to illustrate the related teachings.

Figure 5:
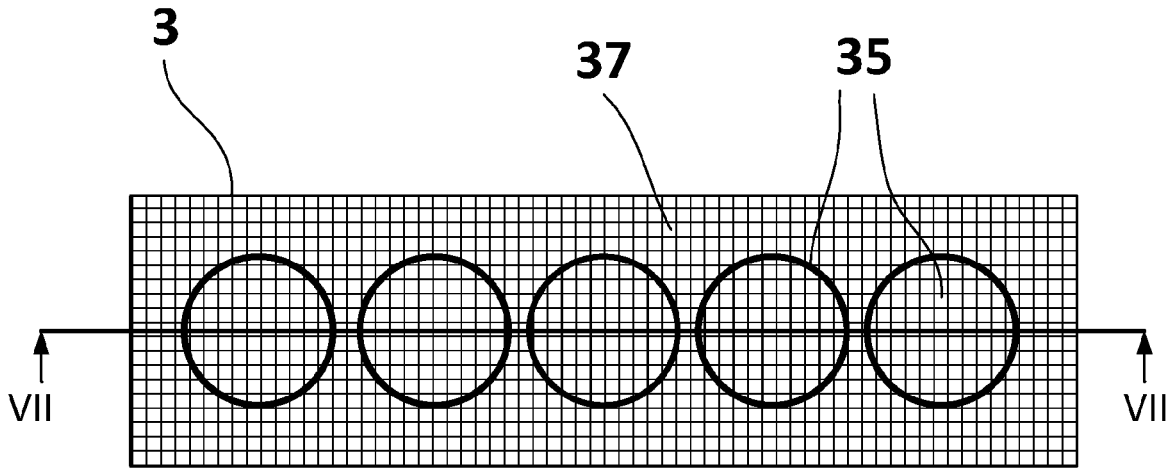
FIG. 5 is a top schematic view of a label stock of a series of labels with the matrix according to one embodiment.
Figure 6:
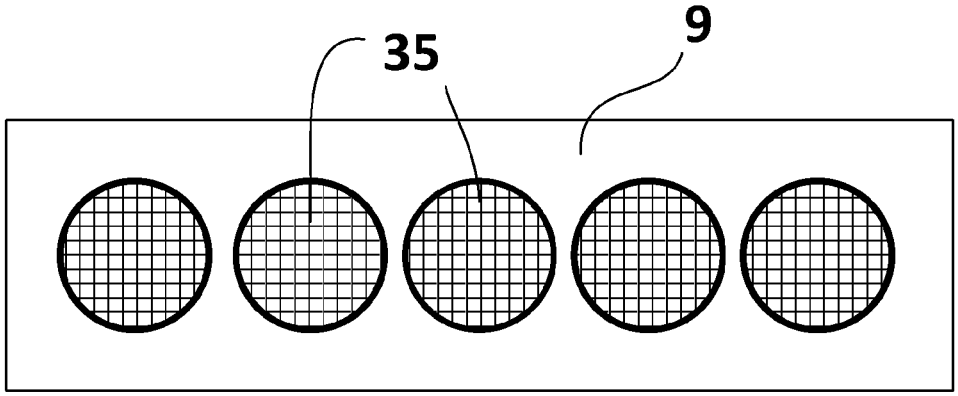
FIG. 6 is a top schematic view of a label stock of FIG. 5 without the matrix according to one embodiment.
Figure 7:
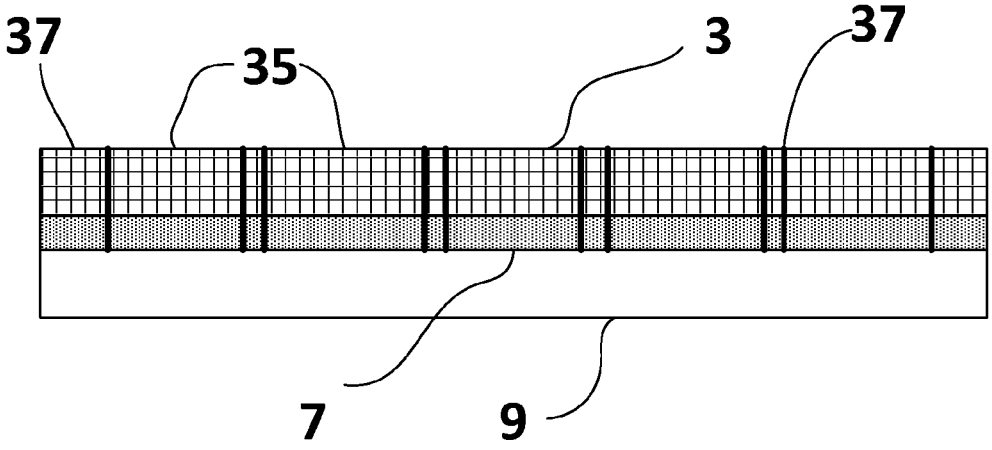
FIG. 7 is a sectional view of FIG. 5 along line VII-VII.

In the example depicted in the drawings, in particular on FIGS. 5 to 7, the pressure-sensitive label stock 3, also named stock strip, comprises a facestock 5, which also comprise the adhesive layer 7, provided as a long or continuous strip typically laminated on a liner 9, unwound from a roll (not shown). Other types of continuous feeding could be used as long as the facestock 5 over the liner 9 can be provided on a continuous basis.

The facestock 5 on the liner 7 forming the stock strip 3 is moved along a path toward a pre-cutting station comprising an anvil roller 11 configured for receiving the stock strip. In the example of the drawings, the pre-cutting station of the apparatus further comprises a cutting roller 13 positioned adjacent to the anvil roller 11. The cutting roller comprises a blade 15 extending from the cylindrical surface of the roller, for cutting the facestock 5 to form a lateral cut 16 from one edge 5A to the other 5B as the facestock passes through a cutting space 17 between the anvil roller 11 and the cutting roller 13. The cutting roller and/or the anvil roller can be moved apart from a cutting position where the blade 15 cuts the facestock 5, to a non-cutting position where the stock strip 3 moves freely between the anvil 11 and cutting 13 rollers once the facestock 5 has been cut by the blade 15.

The apparatus 1 further comprises, downstream from the pre-cutting station, a bending station having a first supporting roller 19, and optionally a second supporting roller 21 located above the first roller 19, for receiving and maintaining the stock strip 3. The strip is therefore received by a third supporting roller 23 downstream the first 19 and second 21 rollers for providing longitudinal tension to the strip 3 in order to maintain the strip 3 in a bent or curved position 25 when moving around the first roller 19.

The bending station of the apparatus as illustrated in the drawings further comprises a movable plate 27 located at adjacent to the first roller on the path of the strip 3 between the first 19 and third 23 rollers. The plate 27 comprises a tip edge 29, preferably having a round shape as shown on FIG. 2, for contacting the liner 9 of the label strip 3. The tie has preferably a round shape as shown on FIG. 2, to make a smoother contact between the plate's tip and the moving strip 3.

Figure 1:
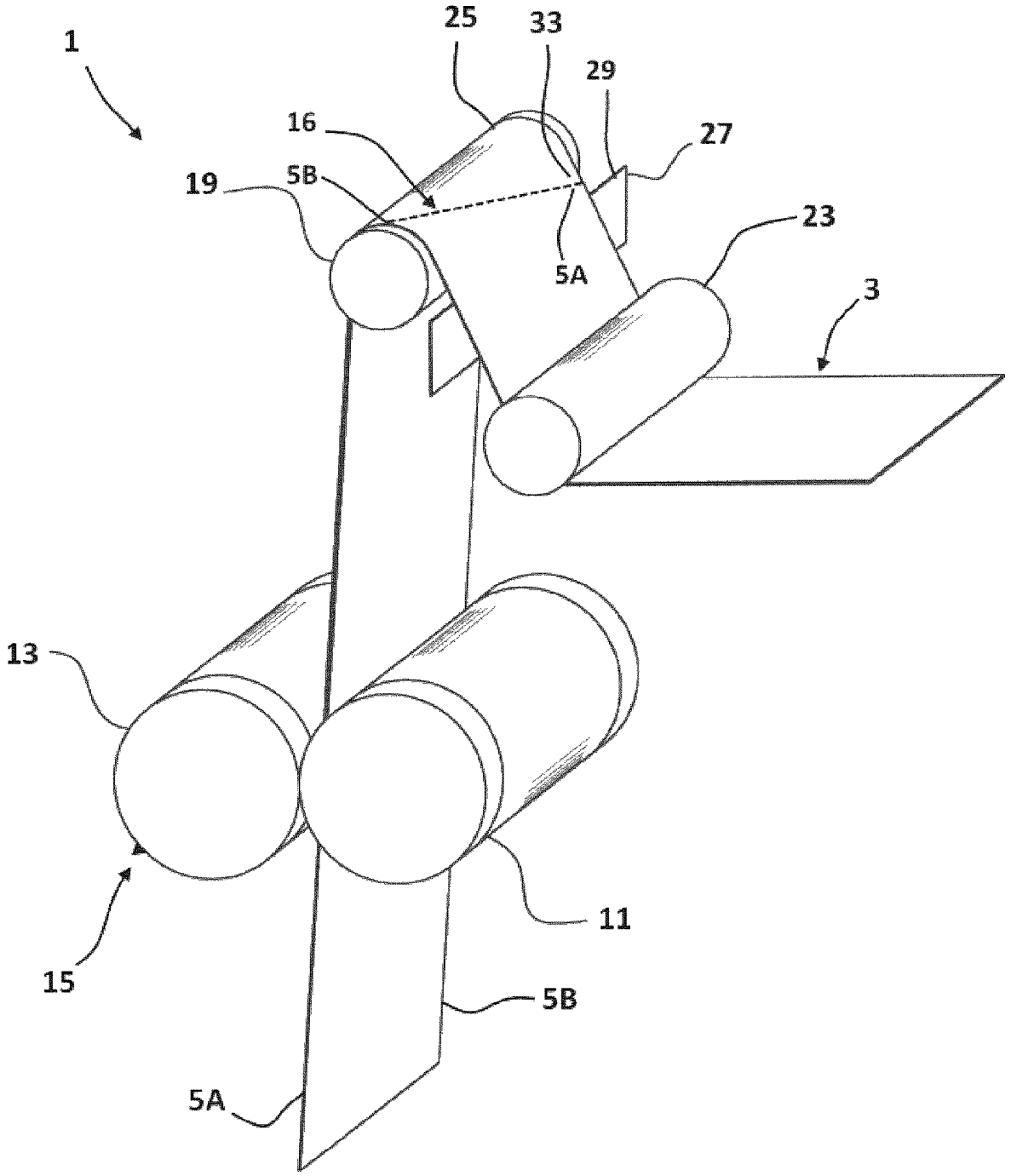
FIG. 1 is a perspective schematic diagram depicting an exemplary apparatus according to one embodiment of the present invention.
Figure 2:
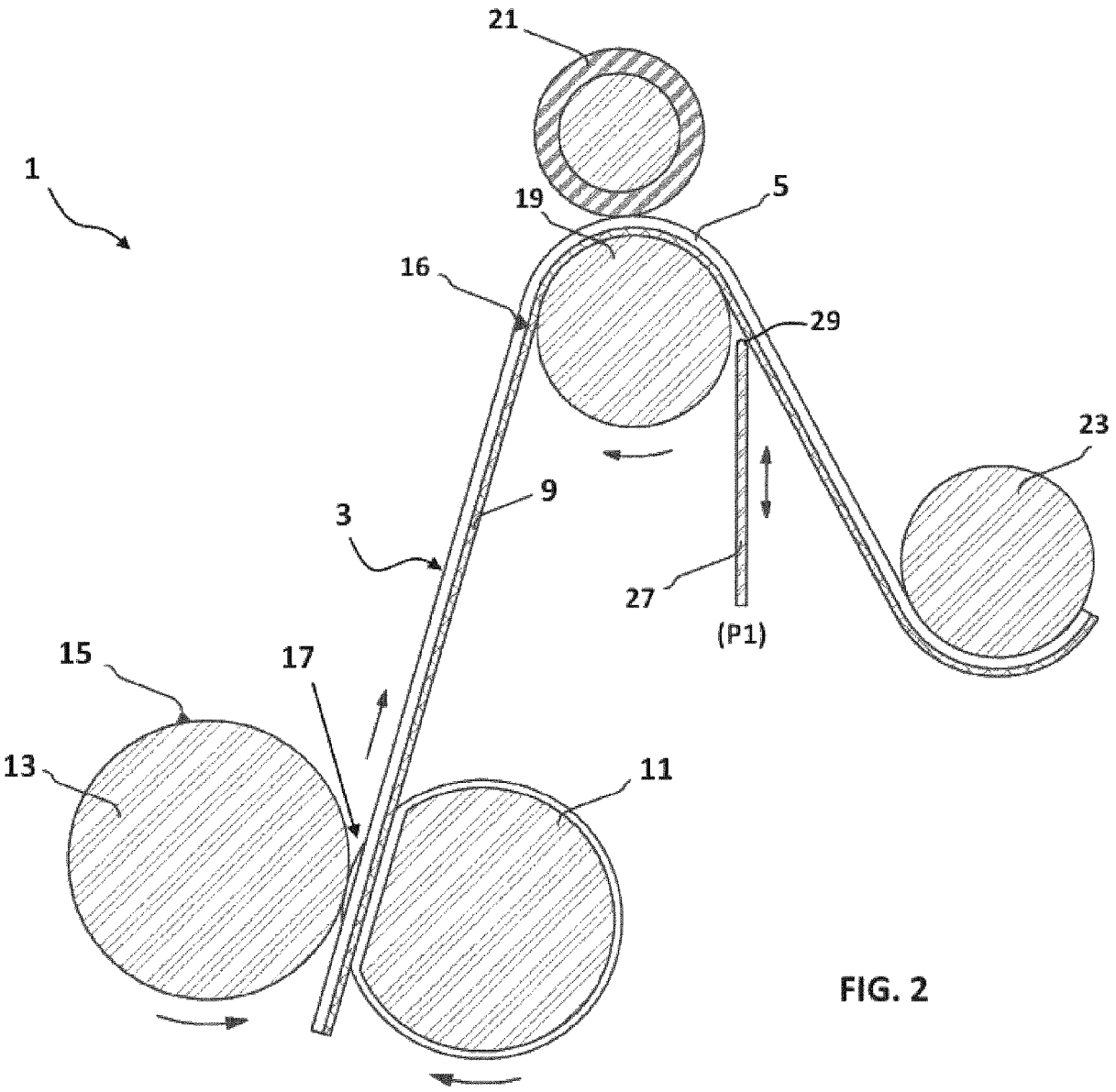
FIG. 2 is a plan schematic view depicting an exemplary apparatus according to one embodiment in sectional view.
Figure 3:
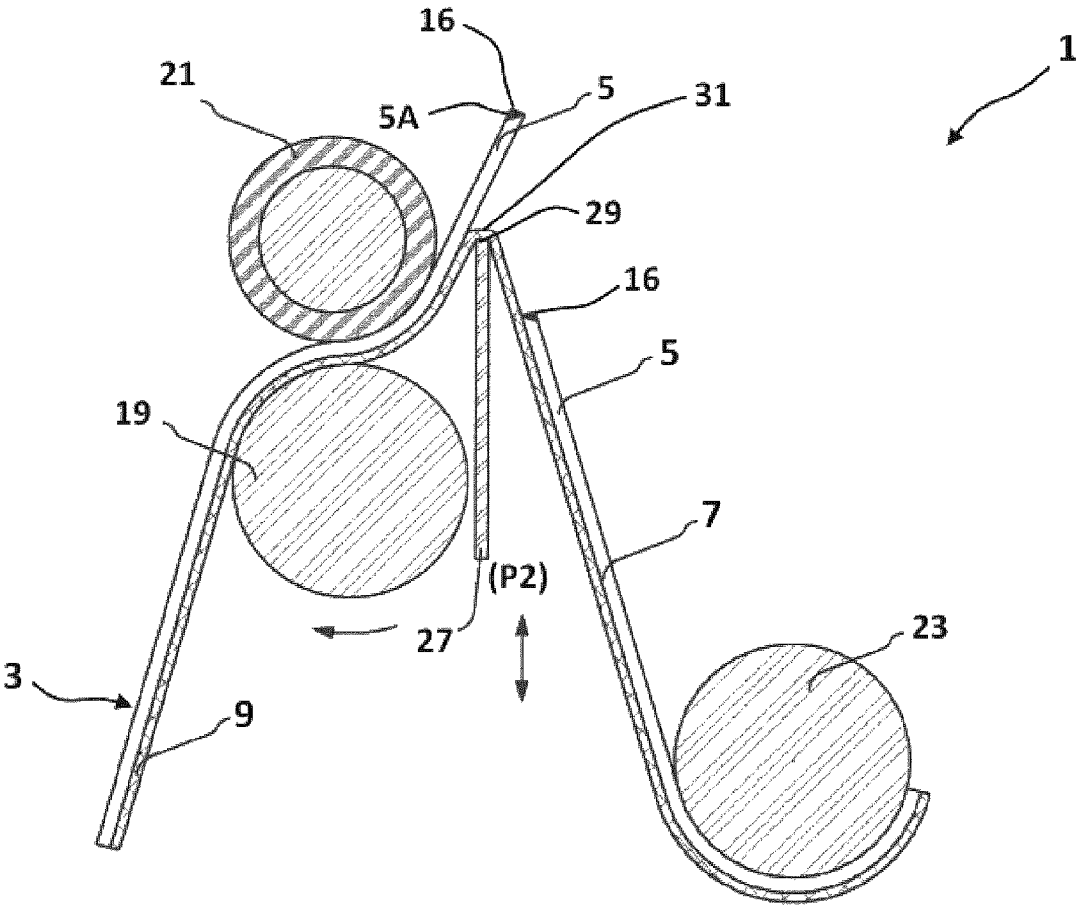
FIG. 3 is a plan schematic view depicting an exemplary apparatus according to one embodiment in sectional view.
Figure 4:
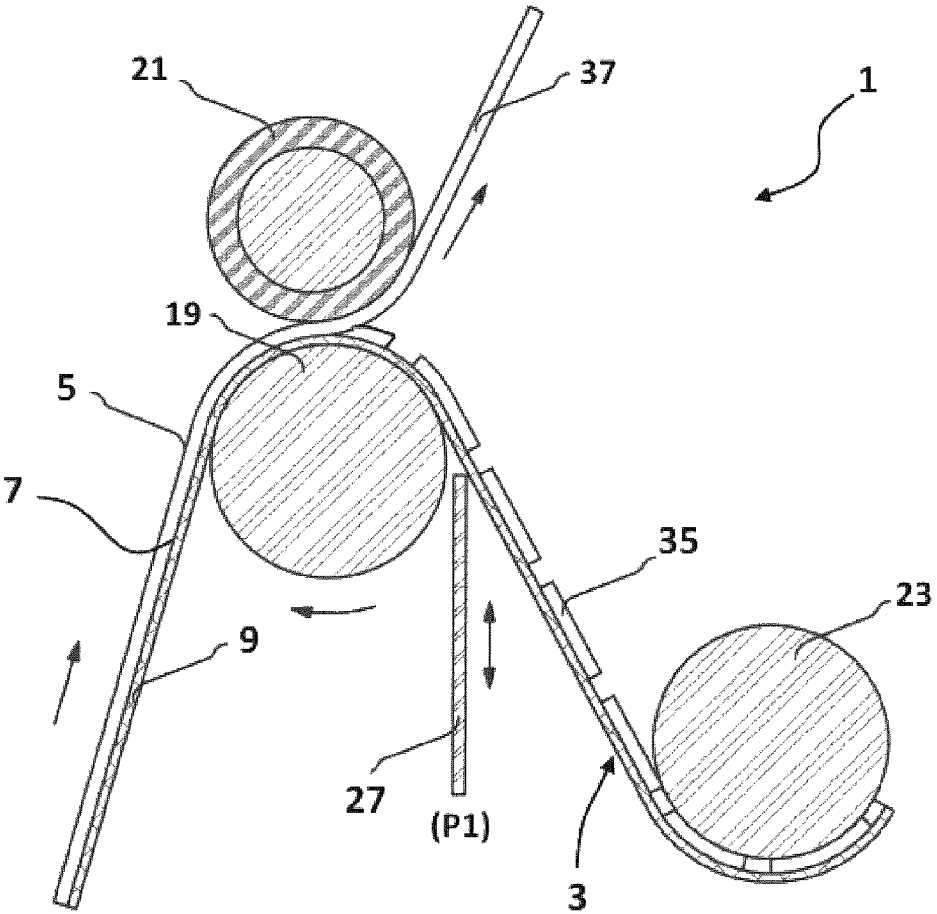
FIG. 4 is a plan schematic view depicting an exemplary apparatus according to one embodiment in sectional view.

The movable plate 27 is configured to be moved between an inactive position (P1) as shown on FIGS. 2 and 4, where the tip edge 29 of the plate 27 is not contacting the strip 3, and an active position (P2) as shown on FIG. 3, where the tip edge 29 of the plate 27 is contacting the strip in a way that the strip 3 forms a sharp angle 31 when moving around the tip edge 29 of the plate 27. As illustrated on FIG. 3, the tip edge 29 of the plate 27 is therefore preferably moved to be located adjacent to the second supporting roller 21.

When the facestock portion, previously cut by the blade 15, moves around the tip edge 29 of the blade 27 and forms the sharp angle 31, the facestock 5 can be easily peeled-off from the liner 7, even when the strip 3 is moving. As illustrated by dotted lines on FIG. 1, the cut 16 made by the blade 15 is preferably not perpendicular to the long edge of the strip 3A in order to form an oblique portion 33 which can easily disengaged from the liner 9 when bending on the tip of the blade. The oblique portion 33 is manually or automatically caught before peeling off the facestock. As illustrated on FIG. 3, the facestock is then sent to a receiving roller (not shown) or vacuumed.

Accordingly, the movement of the plate 27 is coordinated with the movement of the cutting 13 and anvil 11 rollers in order to (1) pre-cut the facestock 5 when moving through the cutting space 17 and (2) forming the sharp angle 31 of the strip 3 to peel-off the facestock 5 from the liner 9. Once the facestock is sent to the receiving roller or vacuumed to be discarded, the plate is moved back to its initial inactive position (P1) as illustrated on FIG. 4.

Once the facestock 5 has been separated from the liner 9, a die-cut station (not illustrated) located upstream from the anvil 11 and the cutting 13 rollers is activated for die-cutting the facestock and forming a plurality of labels 35 along the strip surrounded by the matrix 37. Typically, but not necessarily, about one meter of the facestock is peeled-off from the liner before starting the production of labels with the die-cut station. The die-cut station is configured to be in an open position where the stock moves through the station without being die-cut and a close position where the die-cut station cuts the facestock to form the labels and matrix. As illustrated on FIG. 4, the labels 35 and matrix 37 remain on the liner until the first supporting roller 19 is reached where the matrix 37, as a continuity of the facestock 5, is also peeled-off from the liner 9 and sent to the receiving roller or vacuumed while the die-cut labels 35 remain on the liner and are sent towards the third roller 23.

Skilled persons will readily understand that the present invention focuses on the interface that allows removing the matrix 37 of facestock from the liner 9 while maintaining the label production line running.

It has to be understood that the die-cutting station is in its open position, i.e. when the labels are not die-cut in the facestock, when the cutting roller and the plate are activated to peel-off the facestock from the liner. These actions can be performed without stopping the production line by merely reducing the speed of the moving strip. In general, the speed of the strip on the production line is about 200 meters per minute (m/min) when the labels are die-cut and is decelerated to about 15 m/min when the matrix needs to be peeled off. Advantageously, the present apparatus allows maintaining the strip moving on the production line. It is possible to consider solutions in which the speed of the moving strip may be maintained at a higher speed, possibly up to the full production speed, especially considering that automation (not shown) may be used to capture the edge 5A and transition the captured edge 5A towards the receiving roller or the vacuum.

The rollers 13, 19, 21 and 23 may be free rolling in the apparatus 1. However, a gear mechanism not shown in the example of the drawings may be further provided between the different rollers to ensure that some or all of the rollers rotate in sync. Skilled persons will recognize contexts in which the gear mechanism might be preferred or required (e.g., to more actively prevent skids between the anvil roller 11 and the cutting roller 13).

Figure 8:
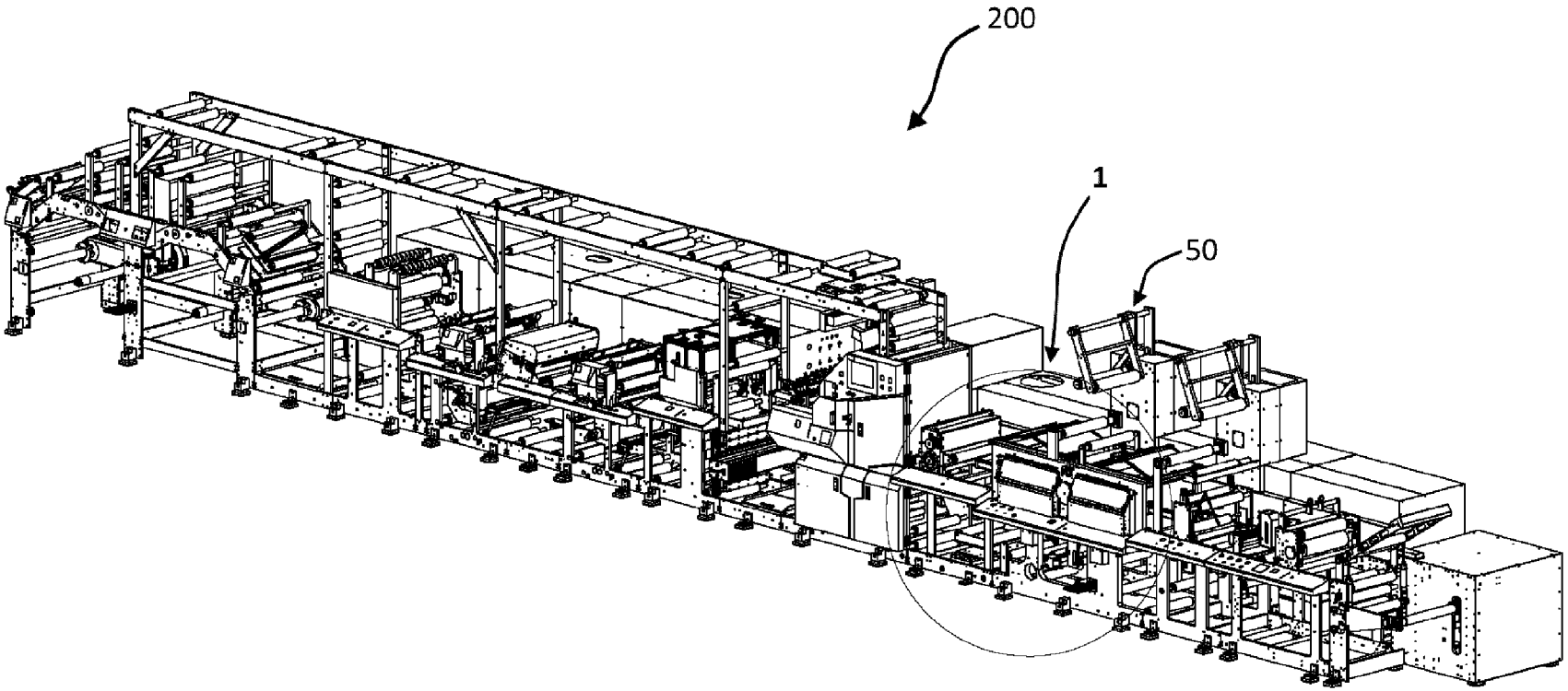
FIG. 8 illustrates a label production line according to a preferred embodiment.
Figure 9:
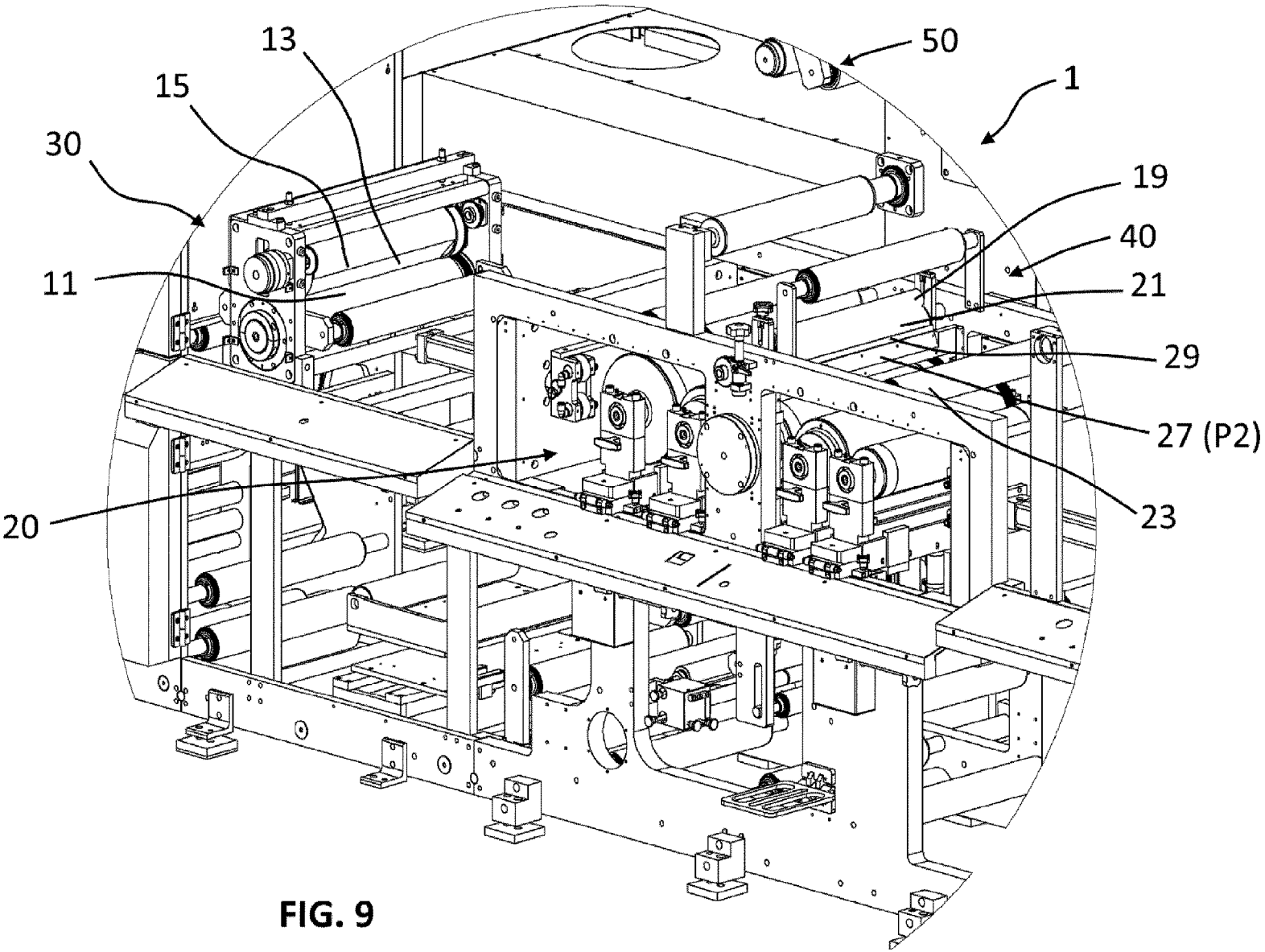
FIG. 9 is a closer view of the FIG. 9 showing in more detail a section of the label production line comprising the apparatus according to a preferred embodiment.

The present invention is also directed to a label production line 200 for the making of a stock strip of pressure-sensitive adhesive stock of labels without stopping the label production line, such as the one illustrated in FIGS. 8 and 9. FIG. 8 shows an entire label production line 200 whereas FIG. 9 is a closer view of the apparatus 1 for removing the matrix as disclosed herein. The apparatus 1 represents one section of the label production line 200 of FIG. 8. The other sections of the line 200 are not discussed, and may ones known in the art of label production.

As for the apparatus, the line 200 is configured to process a stock strip comprising a facestock layer configured to be die-cut to form the stock of labels surrounded by a matrix. The facestock layer is backed by a pressure-sensitive adhesive layer covered by a release liner.

As better illustrated on FIG. 9, the label production line first comprises a die-cut station 20 for die-cutting the facestock layer of the stock strip to form the labels and the matrix.

The label production line 200 also comprises a pre-cutting station 30 located upstream the cutting station of the label production line with a cutting roller 13 positioned adjacent to an anvil roller 11, the cutting roller 13 having a blade 15 extending from the cylindrical surface of the cutting roller for cutting the facestock layer to form a lateral cut when the stock passes through a cutting space defined between the anvil roller and the cutting roller. The lateral cut is formed all along a width of the facestock layer and transversally a longitudinal direction of the label production line.

The production line 200 further comprises a bending station 40 located downstream the pre-cutting station 30 of the label production line, with a first supporting roller 19 (and optionally a second supporting roller located above the first roller) for receiving and maintaining the stock strip, and a third supporting roller 23 located downstream the first supporting roller 19 for receiving and maintaining the stock strip while providing longitudinal tension to the stock strip in order to maintain the stock strip in a curved position when moving around the first roller 19.

The bending station 40 has a movable plate 27 located at adjacent to the first roller 19 on the path of the stock strip between the first and third rollers, the movable plate comprising a tip edge 29 for contacting the release liner along the width of the stock strip. As aforesaid, the movable plate 27 is configured to be moved between: an inactive position (P1) where the tip edge of the plate is not contacting the release liner, and an active position (P2, as in FIG. 9) where the tip edge 29 of the plate is contacting the release liner in a way that the stock strip forms a sharp angle when moving around the tip edge of the plate in order to disengage the pre-cut facestock from the release liner.

In the line 200, the pre-cutting 30 and bending 40 stations are synchronized in use with the die-cut station 20 for starting die-cutting the stock strip when the pre-cut facestock is disengaged from the release liner in order to discard the matrix as a continuity of the pre-cut facestock disengaged from the release liner to make the pressure-sensitive adhesive stock free of the matrix. The label production line 200 is running while the pre-cut facestock is disengaged from the release liner to make the pressure-sensitive adhesive stock free of the matrix.

The cutting and anvil rollers are preferably configured to be moved apart from a cutting position where the blade cuts the facestock layer to a non-cutting position where the stock moves freely between the anvil and cutting rollers once the facestock has been cut by the blade. As shown on FIG. 9, the blade preferably extends from the cylindrical surface of the cutting roller according to a direction that forms a non-perpendicular angle with an edge of the cutting roller in order for the blade, in order to form a lateral cut non-perpendicular to the longitudinal direction of the label production line. The non-perpendicular lateral cut forming an oblique portion of the feedstock layer to ease the disengagement of the feedstock layer from the release liner.

When in the label production line 200, the bending station comprises the aforesaid optional second supporting roller 21 located above the first roller 19, the movable plate 27 in its active position P8 is located adjacent to the second supporting roller 21, as illustrated in FIG. 9.

The tip edge of the movable plate preferably has a round shape to ease the stripe to run around the edge.

In a label production line 200 as illustrated herein, the speed of the stripe can be reduced from about 200 m/min (when the line id producing the labels) to about 15 m/min before activating the pre-cutting and bending station and start discarding the matrix.

The label production line 200 as illustrated on FIG. 8 or 9 may have a discarding station 50 configured for receiving the matrix as a waste after that the matrix is removed or discarded from the feedstock.

Figure 10:
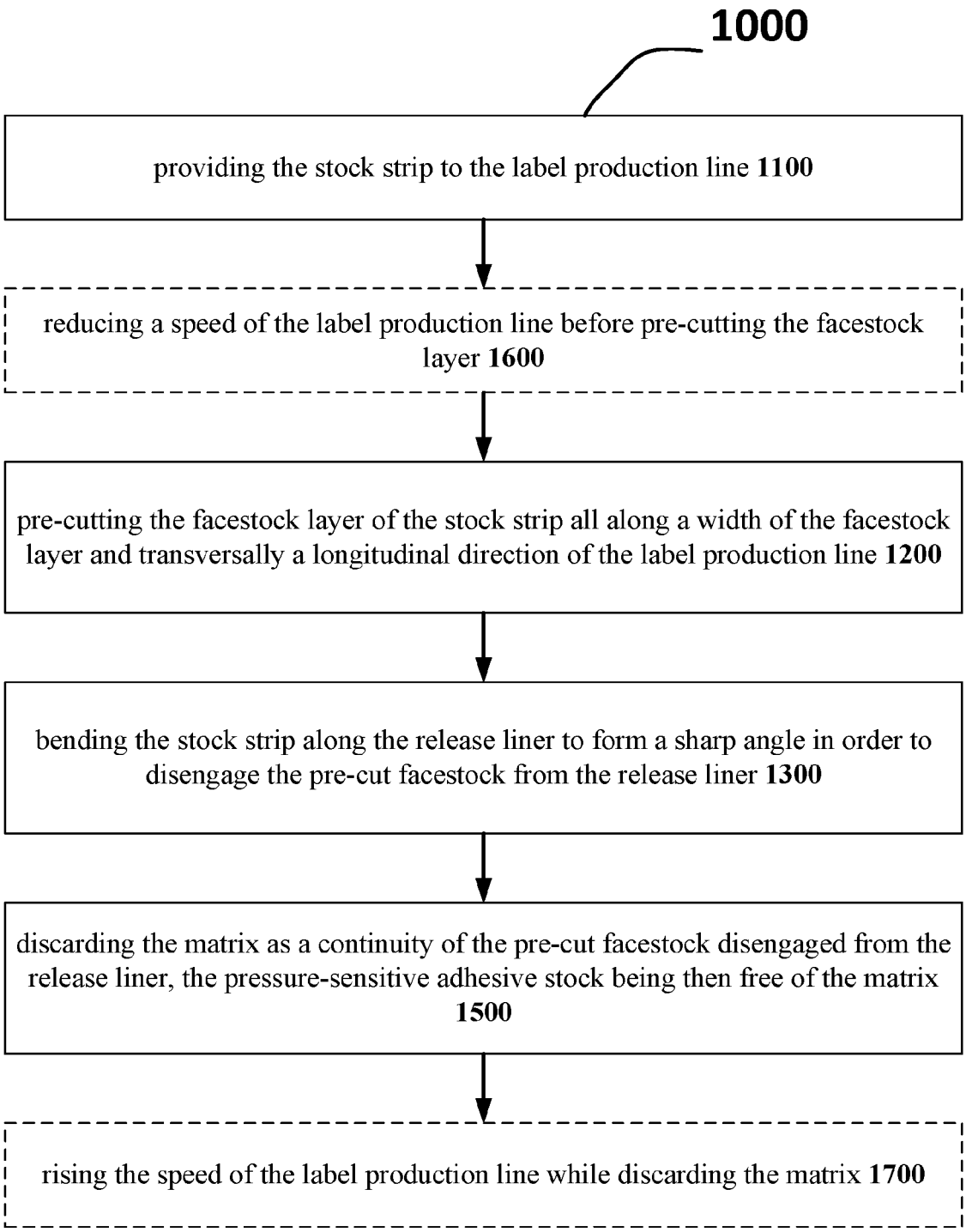
FIG. 10 is a flowchart illustrating the method according to a preferred embodiment.

A method for the making of a stock strip of pressure-sensitive adhesive stock of labels using a label production line is illustrated on FIG. 10. As aforesaid, the stock strip comprises a facestock layer configured to be die-cut to form a stock of labels surrounded by a matrix. The facestock layer is backed by a pressure-sensitive adhesive layer covered by a release liner. The method 1000 comprising the steps of:

providing the stock strip to the label production line 1100;

pre-cutting the facestock layer of the stock strip all along a width of the facestock layer and transversally a longitudinal direction of the label production line 1200;

bending the stock strip along the release liner to form a sharp angle in order to disengage the pre-cut facestock from the release liner 1300;

die-cutting the pressure-sensitive adhesive stock to form the labels and the matrix 1400; and discarding the matrix as a continuity of the pre-cut facestock disengaged from the release liner, the pressure-sensitive adhesive stock being then free of the matrix 1500.

The steps of the method are performed while the production line is running.

According to a preferred embodiment, the method 1000 further comprises the steps of:

reducing a speed of the label production line before pre-cutting the facestock layer 1600; and rising the speed of the label production line while discarding the matrix 1700.

According to a preferred embodiment, the speed is reduced from about 200 m/min to about 15 m/min.

According to a preferred embodiment, the method further comprising the step of applying a longitudinal tension on the stock strip while bending the stock strip 1800.

According to a preferred embodiment, the step of bending the stock strip along the release liner to form a sharp angle in order to disengage the pre-cut facestock from the release liner 1300 comprises the step of pealing-off the feedstock layer from the release liner when the stock strip is moving 1310.

According to a preferred embodiment, the step of pre-cutting the facestock layer of the stock strip 1200 comprises forming a lateral cut non-perpendicular to the longitudinal direction of the label production line in order to form an oblique portion of the feedstock layer to ease the disengagement of the feedstock layer from the release liner. Preferably, the oblique portion is manually or automatically caught before disengaging the pre-cut facestock from the release liner.

The description of the present invention has been presented for purposes of illustration but is not intended to be exhaustive or limited to the disclosed embodiments. Many modifications and variations will be apparent to those of ordinary skill in the art.

The embodiments were chosen to explain the principles of the invention and its practical applications and to enable others of ordinary skill in the art to understand the invention in order to implement various embodiments with various modifications as might be suited to other contemplated uses.

While the illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

What is claimed is:

1. An apparatus for the making of a stock strip of pressure-sensitive adhesive stock of labels using a label production line without stopping the label production line, the stock strip comprising a facestock layer configured to be die-cut to form the stock of labels surrounded by a matrix, the facestock layer being backed by a pressure-sensitive adhesive layer covered by a release liner, the label production line comprising a die-cut station for die-cutting the strip to form the labels and the matrix, the apparatus comprising:

a pre-cutting station located upstream the cutting station of the label production line, and configured for receiving the strip and pre-cutting the facestock layer along a width of the facestock layer and transversally a longitudinal direction of the label production line; and a bending station located downstream the pre-cutting station of the label production line, and configured for receiving the strip with the pre-cut facestock and bending the strip along the release liner in order to disengage the pre-cut facestock from the release liner;

the pre-cutting and bending stations being synchronized in use with the die-cut station for starting die-cutting the stock strip when the pre-cut facestock is disengaged from the release liner in order to discard the matrix as a continuity of the pre-cut facestock disengaged from the release liner to make the pressure-sensitive adhesive stock free of the matrix; and wherein pre-cutting station comprises a cutting roller positioned adjacent to an anvil roller, the cutting roller comprising a blade extending from a cylindrical surface of the cutting roller for cutting the facestock layer to form the lateral cut when the stock passes through a cutting space defined between the anvil and the cutting roller.

2. The apparatus of claim 1, wherein the cutting and anvil rollers are configured to be moved apart from a cutting position where the blade cuts the facestock layer to a non-cutting position where the stock moves freely between the anvil and cutting rollers once the facestock has been cut by the blade.

3. The apparatus of claim 1, wherein the blade extends from the cylindrical surface of the cutting roller with a direction forming a non-perpendicular angle with an edge of the cutting roller in order for the blade to form a lateral cut non-perpendicular to the longitudinal direction of the label production line, the non-perpendicular lateral cut forming as such an oblique portion of the feedstock layer to ease the disengagement of the feedstock layer from the release liner.

4. The apparatus of claim 1, wherein the bending station comprises:

a first supporting roller, and optionally a second supporting roller located above the first roller, for receiving and maintaining the stock strip;

a third supporting roller located downstream the first supporting roller for receiving and maintaining the stock strip while providing longitudinal tension to the stock strip in order to maintain the stock strip in a curved position when moving around the first roller; and a movable plate located adjacent to the first roller on the path of the stock strip between the first and third rollers, the movable plate comprising a tip edge for contacting the release liner along the width of the stock strip when the stock strip is moving, the movable plate being configured to be moved between: an inactive position where the tip edge of the plate is not contacting the release liner, and an active position where the tip edge of the plate is contacting the release liner in a way that the stock strip forms a sharp angle when moving around the tip edge of the plate.

5. The apparatus of claim 4, wherein the bending station comprises said second supporting roller located above the first roller, the movable plate in its active position being located adjacent to the second supporting roller.

6. The apparatus of claim 4, wherein the tip edge of the movable plate has a round shape.

* * * * *